US008545238B2

(12) United States Patent
Takeda et al.

(10) Patent No.: US 8,545,238 B2
(45) Date of Patent: Oct. 1, 2013

(54) ELECTRONIC DEVICE HAVING CONNECTOR

(75) Inventors: Naoya Takeda, Yokohama (JP); Kenji Kumagai, Yokohama (JP)

(73) Assignee: Honda elesys Co., Ltd., Yokohama (JP)

( * ) Notice: Subject to any disclaimer, the term of this patent is extended or adjusted under 35 U.S.C. 154(b) by 0 days.

(21) Appl. No.: 13/455,779

(22) Filed: Apr. 25, 2012

(65) Prior Publication Data

US 2012/0295469 A1 Nov. 22, 2012

(30) Foreign Application Priority Data

Apr. 26, 2011 (JP) ..... P2011-098217

(51) Int. Cl.
*H01R 12/00* (2006.01)

(52) U.S. Cl.
USPC ..... 439/76.1; 439/377; 439/382

(58) Field of Classification Search
USPC ..... 439/76.1, 377, 382
See application file for complete search history.

(56) References Cited

U.S. PATENT DOCUMENTS 6,419,517 B1 * 7/2002 Moden ..... 439/377
6,767,230 B2 * 7/2004 Lai ..... 439/153
7,413,463 B2 * 8/2008 Matsuo ..... 439/377
7,419,385 B2 * 9/2008 Itou et al. ..... 439/76.1
8,308,515 B2 * 11/2012 Chang ..... 439/660
8,347,253 B2 * 1/2013 Kumagai et al. ..... 716/118
8,366,456 B2 * 2/2013 Wu ..... 439/76.1
2012/0295469 A1 * 11/2012 Takeda et al. ..... 439/377
2012/0329296 A1 * 12/2012 Hara et al. ..... 439/76.1

FOREIGN PATENT DOCUMENTS

JP 2007-329413 A 12/2007

* cited by examiner

*Primary Examiner* — James Harvey

(74) *Attorney, Agent, or Firm* — Arent Fox LLP

(57) ABSTRACT

An electronic device having a connector includes a case including an open end and a closed end, a circuit board housed in the case, an inner connector including a conduction terminal which is connected to the circuit board via a connecting portion, an outer connector including a contact face coming in contact with the circuit board, the outer connector being engaged with the open end, and a play preventing portion fixed in the case, and engaged with the circuit board by causing the circuit board to move from the open end to the closed end, wherein a position of the contact face is determined so that the circuit board is pressed by the contact face so as to cause the circuit board to be engaged with the play preventing portion, and the outer connector does not press the inner connector toward the closed end.

6 Claims, 6 Drawing Sheets

ELECTRONIC DEVICE HAVING CONNECTOR

CROSS-REFERENCE TO RELATED APPLICATIONS

Priority is claimed on Japanese Patent Application No. 2011-98217, filed Apr. 26, 2011, the contents of which are entirely incorporated herein by reference.

BACKGROUND OF THE INVENTION

1. Field of the Invention

The present invention relates to an electronic device having a connector with a structure capable of preventing a stress from being applied to a connecting portion (for example, solder) between a conduction terminal and a circuit board.

2. Background Art

In the past, a structure was known in which an inner connector having a terminal section connected to the outside was soldered to a circuit board and the inner connector and the circuit board are housed in a casing. In this structure, in order to prevent the circuit board from rattling, it has been proposed that play preventing means for vertically faxing an edge of the circuit board be disposed in the casing (for example, see JP-A-2007-329413).

SUMMARY OF THE INVENTION

There is a need for incorporation of the casing into a body so as to achieve improvement in dust resistance or the like. When the casing is incorporated into a body in this way, a circuit board is inserted into the casing through an opening for a connector and the edge of the circuit board opposite to the opening needs to be inserted into the play preventing means. However, since a fixing terminal or a fixing plate member used to fix the inner connector to the circuit board is pressed and insert-molded into a resin member of the core of the inner connector, the fixing terminal or the fixing plate member may be displaced from the core. Accordingly, when the circuit board is inserted into the play preventing means or the like, an external force is applied to the terminal section and a stress due to the external force may be applied to the solder (the connecting portion to the circuit board).

The invention is made in consideration of the circumstances, and an object thereof is to provide an electronic device having a connector with a structure capable of preventing a stress from being applied to a connecting portion fixing a connector to a circuit board.

According to an aspect of the invention, there is provided an electronic device having a connector, including: a case including an open end and a closed end; a circuit board housed in the case; an inner connector including a conduction terminal which is connected to the circuit board via a connecting portion; an outer connector including a contact face coming in contact with the circuit board, the outer connector being engaged with the open end while exposing the conduction terminal of the inner connector from the case; and a play preventing portion fixed in the case, and engaged with the circuit board, wherein the play preventing portion is engaged with the circuit board by causing the circuit board to move from the open end to the closed end, and a position of the contact face is determined so that the circuit board is pressed by the contact face so as to cause the circuit board to be engaged with the play preventing portion, and the outer connector does not press the inner connector toward the closed end, when causing the outer connector to be engaged with the open end.

In the electronic device having a connector, the connecting portion may be formed of solder.

In the electronic device having a connector, the outer connector may include a hood section covering the inner connector and the contact face may be formed in the hood section.

In the electronic device having a connector, the outer connector may include an engagement claw engaging with the inner connector.

In the electronic device having a connector, the outer connector may be configured to be slidable in a connector insertion-extraction direction with respective to the inner connector an amount of play at the engagement claw and the contact face may come in contact with the circuit board within the slidable range of the outer connector with respective to the inner connector.

In the electronic device having a connector, the inner connector may include a fixing terminal fixed to the circuit board.

According to the aspect of the invention, when the circuit board is housed in a case and is inserted into the play preventing means, the circuit board can be pressed by the use of the contact face of the outer connector, thereby preventing an external force from being applied to the inner connector. The reaction force of the play preventing means acting on the circuit board can be received by the use of the contact face of the outer connector without using the inner connector. Accordingly, it is possible to prevent a stress from being applied to the connecting portion (for example, solder) used to fix the inner connector to the circuit board, thereby improving the reliability of the connecting portion.

According to another aspect of the invention, since the outer connector can be engaged with the inner connector by the use of the engagement claw, the opening of the case can be reliably closed by the outer connector.

According to another aspect of the invention, since the outer connector slides with respective to the inner connector an amount of play at the engagement claw and the contact portion comes in contact with the circuit board within this slidable range, it is possible to press the circuit board by the use of the contact portion of the outer connector and to reliably insert the circuit board into the play preventing means.

According to another aspect of the invention, when the conduction terminal and the fixing terminal are fixed to the circuit board, for example, through the use of the solder, it is possible to prevent a stress from being applied to the solder.

DETAILED DESCRIPTION OF THE INVENTION

Figure 1:
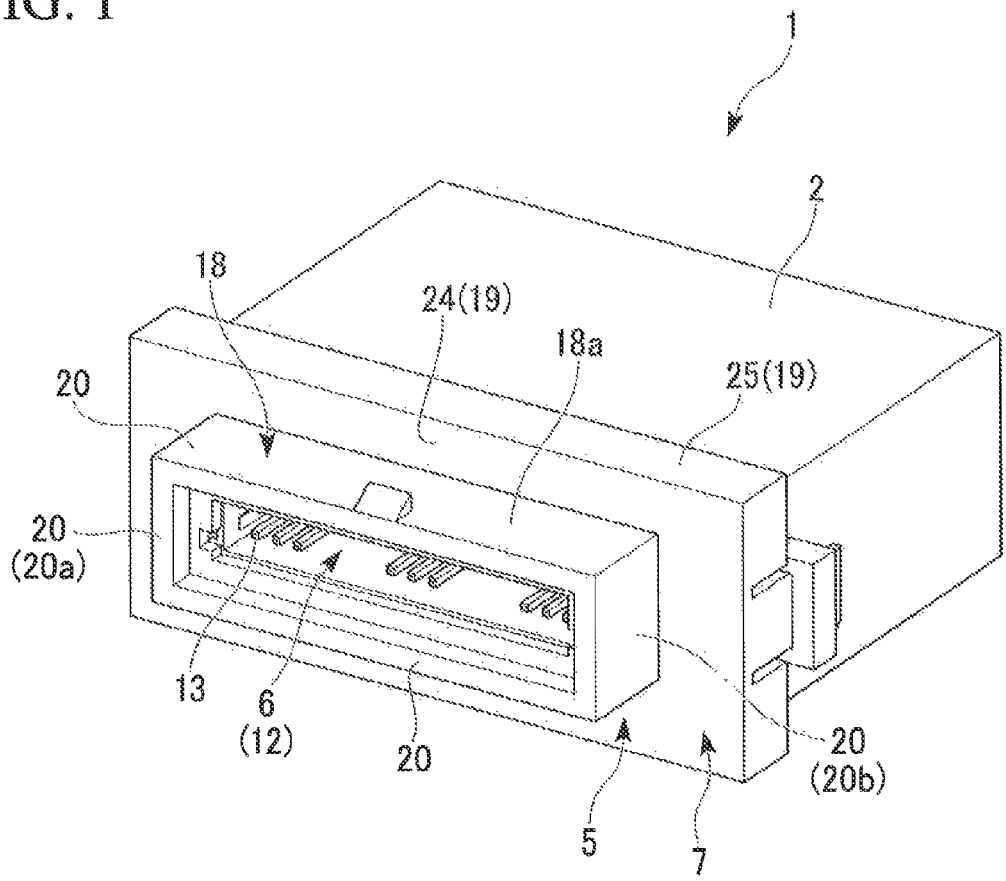
FIG. 1 is a perspective view of an electronic device having a conduction-terminal solder stress preventing structure according to an embodiment of the invention.
Figure 2:
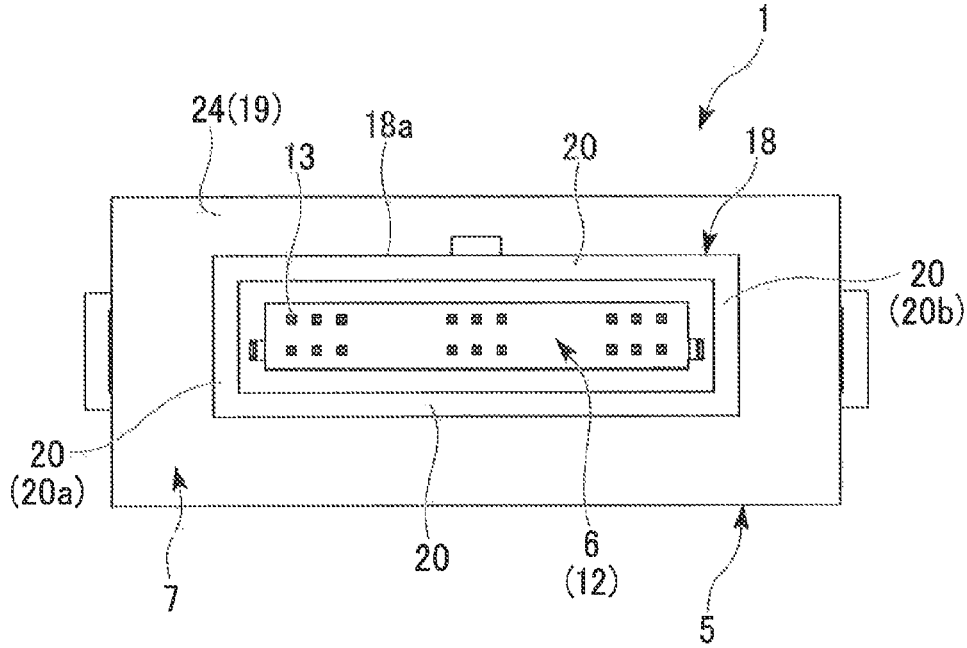
FIG. 2 is a front view of the electronic device.
Figure 3:
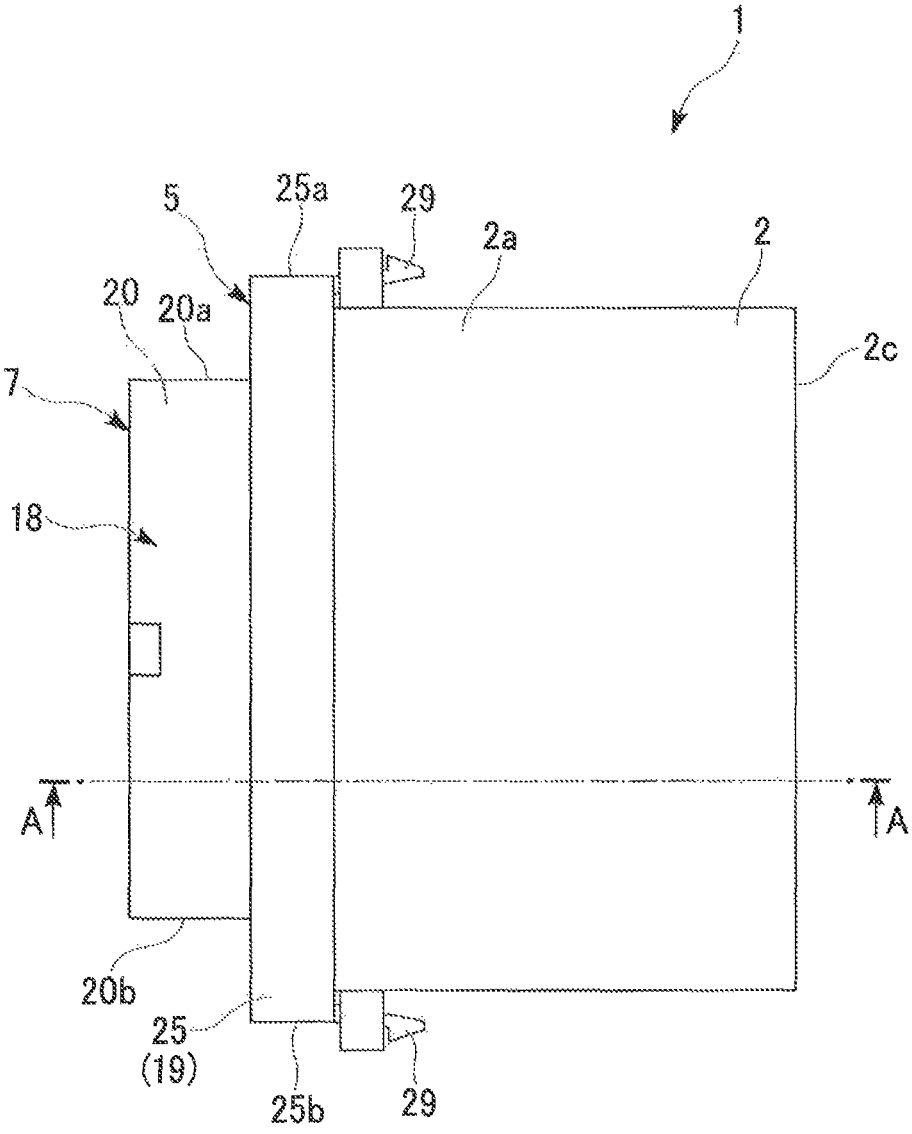
FIG. 3 is a top view of the electronic device.

Hereinafter, a conduction-terminal solder stress preventing structure according to an embodiment of the invention will be described with reference to the accompanying drawings.

FIGS. 1 to 7 show an electronic device having a conduction-terminal solder stress preventing structure according to this embodiment. In the electronic device 1, a circuit board 3 is housed in a box-like case 2 having an opening 10 at one end (see FIG. 4). The case 2 includes a closed end 2*c* on the opposite end of the opening 10. The circuit board 3 is a printed circuit board including lands, wiring patterns, and through-holes (none of which are shown) and is mounted with electronic components (none of which are shown) such as a microcomputer, resistors, and capacitors.

A play preventing portion 4 preventing rattling of the circuit board 3 is formed in the case 2. The play preventing portion 4 shown in FIGS. 4, 5, and 7 includes elastic members which are vertically arranged with a gap 11 slightly smaller than the thickness of the circuit board 3. In this example, the play preventing portion 4 is disposed at two positions in the horizontal direction perpendicular to a connector insertion-extraction direction and vertically pinches an inner end edge of the circuit board 3 to prevent the rattling of the circuit board 3 when the inner end edge is pressed into the gap 11. The play preventing portion 4 is not limited to the above-mentioned structure, as long as it can prevent the rattling of the circuit board 3 by pinching the end edge of the circuit board.

A connector 5 electrically connecting the circuit board 3 to an external device (not shown) is mounted on the opening 10 of the case 2. The connector 5 includes an inner connector 6 connected to the circuit board 3 and an outer connector 7 closing the opening 10 of the case 2.

The inner connector 6 includes a terminal section 12 opened in the same direction as the opening direction of the case 2 and a plurality of pins (conduction terminals) 13 extending to the vicinity of the opening 12*b* of the terminal section 12 through a bottom 12*a* of the terminal section 12. The pins 13 are formed of a conductive material and are formed in a body with the terminal section 12 formed of a resin material.

The terminal section 12 of the inner connector 6 is formed in a substantially rectangular longitudinal cross-section long along the end edge of the circuit board 3. In the terminal section 12, a support 14 (see FIGS. 4 and 6) is formed to protrude along the pins 13 in the back of the bottom 12*a*. A fixing terminal 15 having a substantially cylindrical shape extending vertically from the bottom 14*a* thereof is formed in a body with the support 14. The fixing terminal 15 is fixed to the circuit board 3 through a hole 16 (see FIG. 7) such as a through-hole formed in the circuit board 3 by soldering. A fixing plate member having a substantially flat panel shape may be formed to be soldered to the circuit board 3 instead of the fixing terminal 15 formed in a substantially cylindrical shape. Here, the method of fixing the fixing terminal 15 to the circuit board 3 is a soldering method; however, it may be changed to fixing using a brazing method, fixing using an adhesive, fixing using plastic deformation of metal, and the like.

Figure 4:
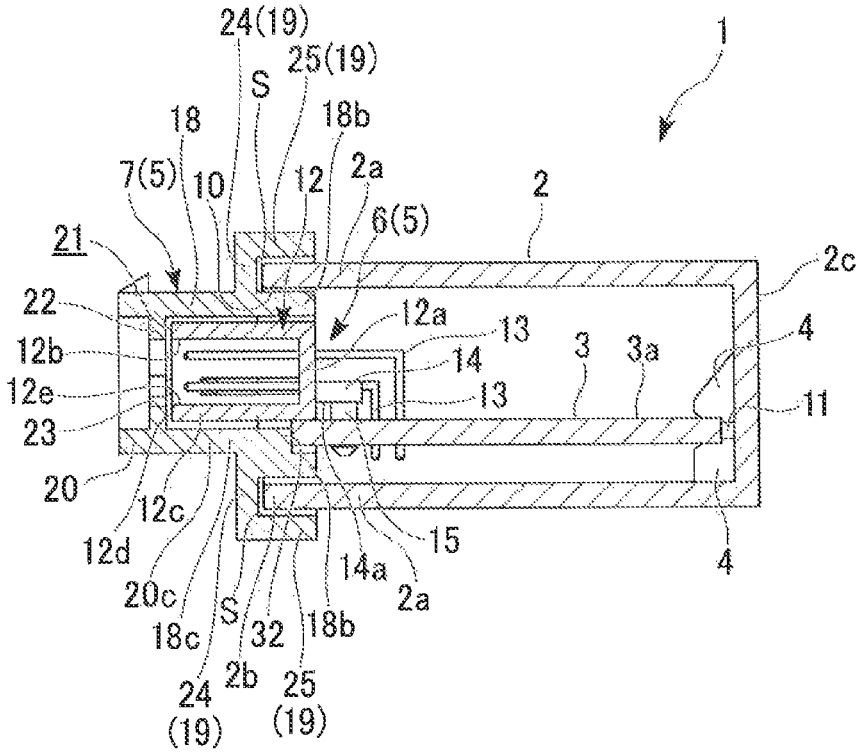
FIG. 4 is across-sectional view taken along the line A-A in FIG. 3.
Figure 5:
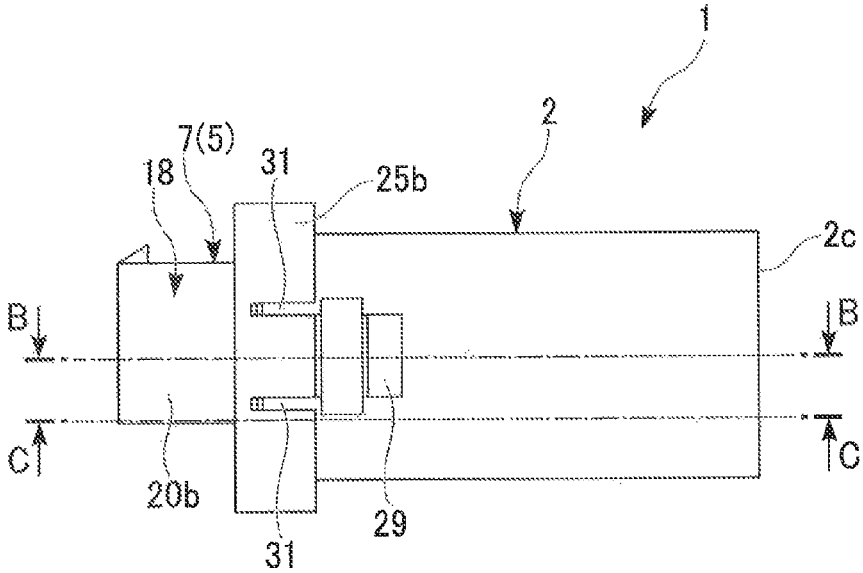
FIG. 5 is a right side view of the electronic device.
Figure 6:
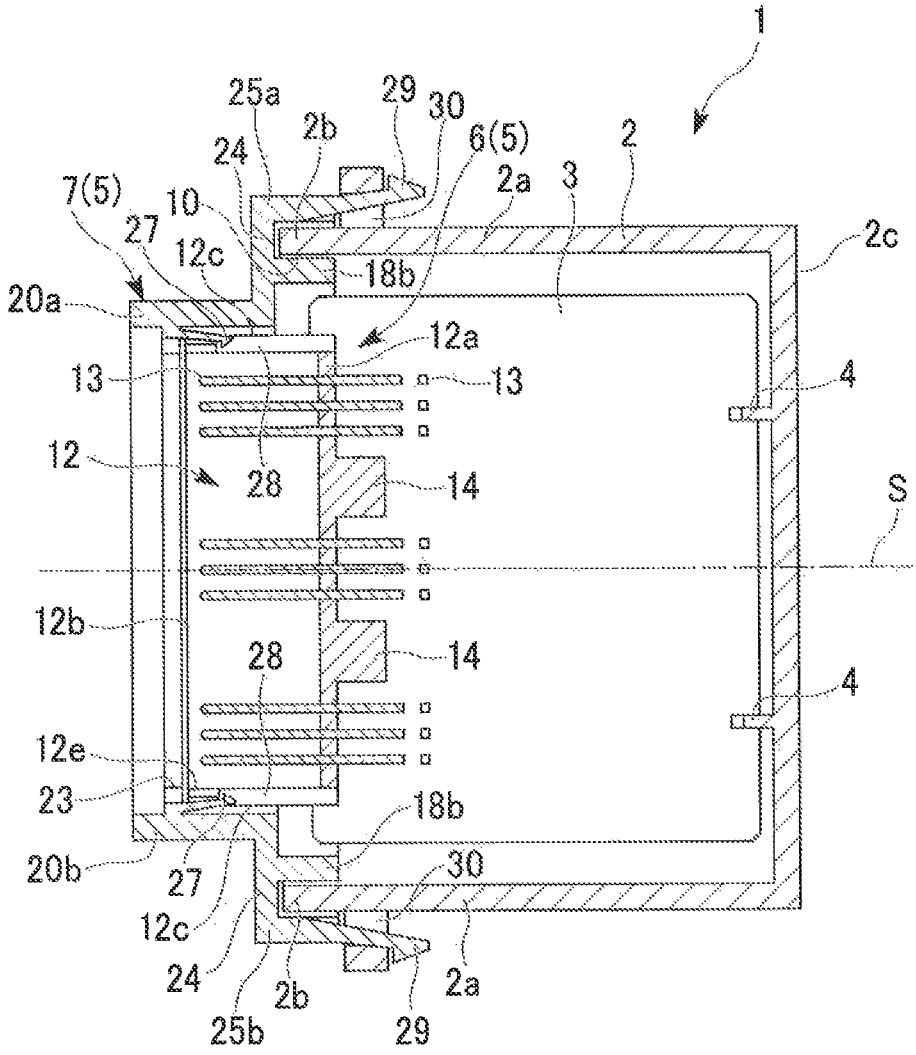
FIG. 6 is a cross-sectional view taken along the line B-B in FIG. 5.
Figure 7:
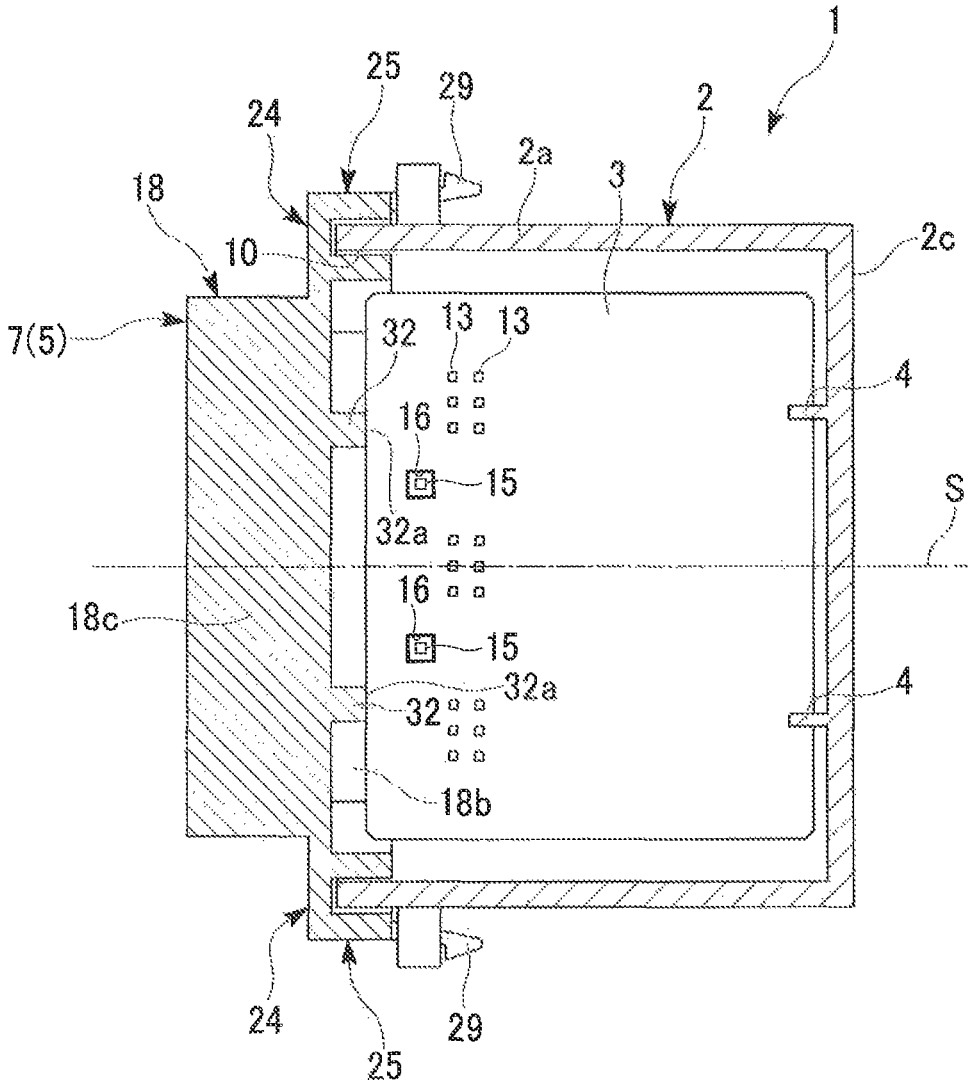
FIG. 7 is a cross-sectional view taken along the line C-C in FIG. 5.

On the other hand, the pins 13 pass through the bottom 12*a* of the terminal section 12 toward the rear surface, are bent vertically, are inserted into a through-hole of the circuit board 3, and are fixed to the circuit board 3 by soldering. In this way, by soldering the pins 13 and the fixing terminal 15, the inner connector 6 is fixed and connected to the circuit board 3 in a state where it is partially in contact with the surface 3*a* (see FIG. 4) of the circuit board 3. In FIGS. 4, 6, and 7, the soldered portions are not shown for the purpose of convenience. Here, the method (formation of a connecting portion) of fixing the pins 13 to the circuit board 3 is a soldering method; however, it may be changed to fixing using a brazing method, fixing using an adhesive, fixing using plastic deformation of metal, and the like.

The outer connector 7 includes a hood section 18 covering the terminal section 12 and a closed section 19 closing the opening 10 of the case 2. The hood section 18 includes four wall portions 20 substantially parallel to the wall 12*c* constituting the terminal section 12 of the inner connector 6. In a state where it is fixed to the case 2, the base end thereof is disposed to enter the inner surface of a peripheral wall portion 2*a* of the case 2 from the opening 10 and the front end thereof is formed to extend to the outside in the insertion-extraction direction of the connector 5 from the terminal section 12 of the inner connector 6. The outer connector 7 is set to form a predetermined gap 21 from the terminal section 12 the inner connector 6 all over the periphery in a state where it is fixed to the case 2. An intermediate wall portion 22 substantially perpendicular to the wall portion 20 is formed in the outer connector 7 with a predetermined gap 21 from the opening edge 12*d* (see FIG. 4) of the terminal section 12.

An opening 23 having the same size as the opening 12*e* of the terminal section 12 is formed in the intermediate wall portion 22, and the opening of the outer connector 7 and the terminal section 12 of the inner connector 6 communicate with each other via the opening 23 of the intermediate wall portion 22.

The closed section 19 includes a main plate portion 24 extending vertically from the outer surface 18*a* (see FIG. 1) of the hood section 18 and a guide wall portion 25 rounding the outer surface of the peripheral wall portion 2*a* of the case 2 from the edge of the main plate portion 24 and extending along the peripheral wall portion 2*a* of the case 2. The main plate portion 24 is formed in a substantially rectangular shape slightly larger than the case 2, more specifically, slightly larger than the thickness of the peripheral wall portion 2*a* of the case 2, as viewed from the insertion-extraction direction of the connector 5. Accordingly, an opening end 2*b* of the case 2 can be slidably inserted between the guide wall portion 25 of the outer connector 7 and the base end 18*b* (see FIG. 4) of the hood section 18. A guide concave portion is constituted by the guide wall portion 25 and the base end 18*b* of the hood section 18.

As shown in FIG. 4, a seal member S used to guarantee water tightness and air tightness of the case 2 may be interposed between the inner surface of the main plate portion 24 and the opening end 2*b* of the case 2 and between the guide wall portion 25 and the opening end 2*b*. Accordingly, when the outer connector 7 is fixed to the case 2, moisture or dust can be made to not infiltrate into the case 2 through the opening 10.

In the hood section 18 of the outer connector 7, engagement claws 27 (see FIG. 6) protruding inward are formed in two opposite wall portions 20*a* and 20*b* and slits 28 capable of engaging with the engagement claws 27 are formed in the horizontal wall portions 12*c* of the terminal section 12 of the inner connector 6 at positions opposed to the engagement claws 27. By inserting the engagement claws 27 into the slits 28, the outer connector 7 is fixed to the inner connector 6 with play in the insertion-extraction direction of the connector 5, that is, in a state where slight sliding is allowed.

Engagement claws 29 extending in the extending direction of the guide wall portions 25*a* and 25*b* are formed in a pair of guide wall portions (the right and left guide wall portions in FIG. 6) 25*a* and 25*b* parallel to each other, and engagement holes 30 into which the engagement claws 29 are inserted to engage each other are formed in the right and left main plate portions 2*a* of the case 2. The engagement claws 29 can be elastically deformed in the right-left direction. Slits 31 (see FIG. 5) are formed on both sides of the engagement claws 29 in the guide wall portions 25*a* and 25*b* close to the base ends of the engagement claws 29 so that the deformation of the engagement claws 29 is enlarged.

Figure 8:
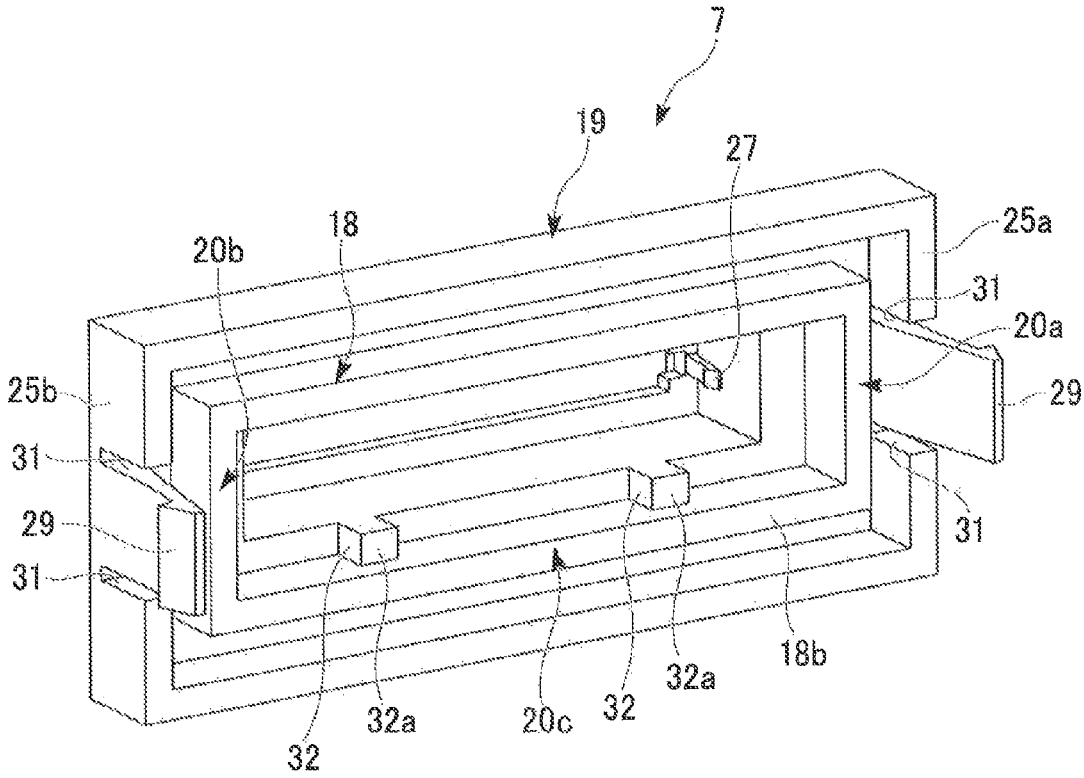
FIG. 8 is a perspective view of an outer connector as viewed from the rear side.

As shown in FIGS. 4, 6, and 8, the hood section 18 of the outer connector 7 is formed in a stepped shape so that the wall portions 20*a* and 20*b* and the wall portion 20*c* in which the circuit hoard 3 is disposed are offset outside. The base portion 18*b* of the hood section 18 is arranged to be parallel to the guide wall portions 25 with a predetermined gap slightly larger than the thickness of the peripheral wall portion 2*a* of the case 2.

An intermediate portion 18*c* (see FIG. 4) of the hood section 18 is disposed in an extension line of the circuit board 3 in a state where the outer connector 7 is fixed to the case 2, and two contact portions 32 (see FIGS. 7 and 8) coming in contact with the end edge of the circuit board 3 close to the opening 10 are disposed at the end edge of the intermediate portion 18*c* disposed in the extension line and dose to the circuit board 3. The contact portions 32 protrude in a substantially cubic shape, have a contact face 32*a*, and are disposed at positions opposed to the play preventing portions 4 with the circuit board 3 interposed therebetween.

That is, the contact portions 32 are arranged at positions symmetric about the center in the length direction (which is indicated by a one-dot chained line S in FIGS. 6 and 7) of the opening 12*b* of the inner connector 6, similarly to the play preventing portions 4.

The outer connector 7 is configured to slide an amount of play at the engagement claws 27 in the insertion-extraction direction of the connector 5 with respective to the inner connector 6, and the contact faces 32*a* of the contact portions 32 come in contact with the end edge of the circuit board 3 within the slidable range of the outer connector 7 with respective to the inner connector 6. The positions of the contact faces 32*a* are determined so that the circuit board 3 is pressed by the contact faces 32*a*, the circuit board 3 is engaged with the play preventing portions 4, and the outer connector 7 does not press the inner connector 6 toward the closed end 2*c* of the case 2, when the outer connector 7 is engaged with the opening end 2*b*.

By employing this arrangement, the reaction force applied from the circuit board 3 can be efficiently received by the contact portions 32 (the contact faces 32*a*) when pressing the end edge of the circuit board 3 into the play preventing portions 4. As shown in FIG. 4, a slight gap is formed between the circuit board 3 and the base portion 18*b* of the hood section 18, whereby the end edge of the circuit board 3 does not contact the base portion 18*b* of the hood section 18 when fixing the outer connector 7.

The electronic device 1 according to this embodiment has the above-mentioned configuration. The method of receiving the circuit hoard 3 in the case 2 in the electronic device 1 will be described below.

First, the inner connector 6 is fixed to the circuit board 3 by soldering, and the terminal section 12 of the inner connector 6 is inserted into the inner surface of the hood section 18 of the outer connector 7 in the insertion-extraction direction of the connector 5. Accordingly, the engagement claws 27 of the hood section 18 are inserted into the slits 28 of the terminal section 12, and the outer connector 7 is engaged with the inner connector 6 with a slight play in the connector insertion-extraction direction. At this time, since a gap is formed between the outer connector 7 and the inner connector 6, an external force is not applied to the terminal section 12.

Here, when the opening end 2*b* of the case 2 is inserted into the guide concave portion constituted by the guide wall portions 25 and the base portions 18*b* of the hood section 18 the outer connector 7 is guided in the direction parallel to the circuit board 3. Accordingly, it is possible to prevent the outer connector 7 from pressing the inner connector 6 in the process of fixing the outer connector 7.

Subsequently, the circuit board 3 is inserted through the opening 10 of the case 2. In this case, the circuit board 3 is inserted to the case 2 from the side opposite to the connector 5. The outer connector 7 is pressed to insert the end edge of the circuit board 3 opposite to the connector 5 into the gaps 11 of the play preventing portions 4, to insert the opening end 2*b* between the guide wall portions 25 and the base portions 18*b* of the hood section 18, and causes the engagement claws 29 to engage the engagement holes 30. At this time, a pressing force acts directly on the circuit board 3 from the contact portions 32 (the contact faces 32*a*) of the outer connector 7, the circuit board 3 is pressed in the gaps 11 of the play preventing portions 4, and the reaction force applied to the circuit board 3 from the play preventing portions 4 is applied to the contact portions 32 (the contact faces 32*a*) via the end of the circuit board 3 close to the connector 5. Accordingly, the connector 5 is fixed to the case 2.

Therefore, in the connecting structure of the connector 5 according to the embodiment of the invention, when the circuit board 3 is housed in the case 2 and is inserted into the play preventing portions 4, the circuit board 3 is pressed by the contact portions 32 (the contact faces 32*a*) of the outer connector 7, thereby preventing an external force from being applied to the inner connector 6. Since the reaction force from the play preventing portions 4 acting on the circuit board 3 can be received through the use of the contact portions 32 (the contact faces 32*a*) of the outer connector 7 without being transmitted to the inner connector 6, it is possible to prevent a stress from being applied to the solder used to fix the inner connector 6 to the circuit board 3.

Since the outer connector 7 slides with respective to the inner connector 6 an amount of play at the engagement claws 27 and the contact portions 32 (the contact faces 32*a*) come in contact with the circuit board 3 within the slidable range, it is possible to reliably insert the circuit board into the play preventing portions 4.

When the fixing terminal 15 and the pins 13 are fixed to the circuit board 3 by soldering, it is possible to prevent a stress from being applied to the solder of the fixing terminal 15 and the pins 13

Since the outer connector 7 can be engaged with the inner connector 6 through the use of the engagement claws 27, it is possible to reliably close the opening 10 of the case 2 by the use of the outer connector 7.

The invention is not limited to the configuration of the above-mentioned embodiment, and the design may be modified without departing from the concept thereof.

For example, in the connecting structure of the connector 5 according to the embodiment, the outer connector 7 is fixed to the case 2 through the use of the engagement claws 29 and the outer connector 7 is fixed to the inner connector 6 through the use of the engagement claws 27. However, the fixing of the outer connector 7 is not limited to the fixing using a claw-like member, but the outer connector 7 may be fixed to the inner connector 6, for example, through the use of locking or adhesion.

In the above-mentioned embodiment, the contact portions 32 are formed at two positions to protrude in a substantially cubic shape. However, as long as the circuit board 3 can be properly pressed against the play preventing portions 4, the contact portions are not limited to the substantially cubic shape, and are not limited to two positions, and may be formed at one position or three or more positions.

In the above-mentioned embodiment, three sets of pins 13, each set of which includes pins 13 arranged in two rows and three columns, are arranged in the terminal section 12 with a predetermined gap interposed therebetween (see FIG. 2); however, the arrangement of the pins is not limited to this arrangement.

Although it has been stated that the fixing terminal 15 of the inner connector 6 is made to pass through the hole 16 and is fixed by soldering, a so-called surface-mounted inner connector 6 not using the hole 16 may be fixed to the circuit board 3 by soldering.

Although it has been stated that the connector 5 has only one opening, the connector may have a plurality of openings.

What is claimed is:

1. An electronic device having a connector, comprising:

a case including an open end and a closed end;

a circuit board housed in the case;

an inner connector including a conduction terminal which is connected to the circuit hoard via a connecting portion;

an outer connector including a contact face coming in contact with the circuit board, the outer connector being engaged with the open end while exposing the conduction terminal of the inner connector from the case; and a play preventing portion fixed in the case, and engaged with the circuit board, wherein the play preventing portion is engaged with the circuit board by causing the circuit board to move from the open end to the closed end, and a position of the contact face is determined so that the circuit board is pressed by the contact face so as to cause the circuit board to be engaged with the play preventing portion, and the outer connector does not press the inner connector toward the closed end, when the outer connector is engaged with the open end.

2. The electronic device having a connector according to claim 1, wherein the connecting portion is formed of solder.

3. The electronic device having a connector according to claim 1, wherein the outer connector includes a hood section covering the inner connector and the contact face is formed in the hood section.

4. The electronic device having a connector according to claim 1, wherein the outer connector includes an engagement claw engaging with the inner connector.

5. The electronic device having a connector according to claim 4, wherein the outer connector is configured to be slidable in a connector insertion-extraction direction with respective to the inner connector by an amount of play at the engagement claw and the contact face comes in contact with the circuit board within the slidable range of the outer connector with respective to the inner connector.

6. The electronic device having a connector according to claim 1, wherein the inner connector includes a fixing terminal fixed to the circuit board.

* * * * *